US006439438B1

(12) United States Patent
Schouten et al.

(10) Patent No.: US 6,439,438 B1
(45) Date of Patent: Aug. 27, 2002

(54) COMBINATION FOR STORING AND APPLYING HEAT SOFTENABLE MOISTURE CURABLE MATERIALS

(75) Inventors: Gerald P. Schouten, Hudson, WI (US); Walter C. Pearson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/812,149

(22) Filed: Mar. 19, 2001

(51) Int. Cl.[7] ..... B67D 5/00
(52) U.S. Cl. ..... 222/326; 222/1; 222/391
(58) Field of Search ..... 222/1, 325–327, 222/386, 390, 391

(56) References Cited

U.S. PATENT DOCUMENTS

| | | | | |
|---|---|---|---|---|
| 4,065,034 A | | 12/1977 | Callan | 222/146 |
| 4,661,542 A | * | 4/1987 | Gilch et al. | 524/59 |
| 4,926,029 A | | 5/1990 | Pearson | 219/421 |
| 5,026,187 A | | 6/1991 | Belanger | 401/1 |
| 5,139,178 A | * | 8/1992 | Arch et al. | 222/326 |
| 5,776,406 A | * | 7/1998 | Schubert et al. | 264/328.1 |
| 6,172,295 B1 | * | 1/2001 | Hattori et al. | 136/251 |

FOREIGN PATENT DOCUMENTS

| | | |
|---|---|---|
| DE | 197 42 240 A | 4/1999 |
| JP | 05007601 | 1/1993 |

OTHER PUBLICATIONS

Advertising Brocure entitled 3M Jet–Weld (t.m.) Thermoset Adhesive System copyrighted 1996.
Designer's Reference Guide entitled "3M Adhesive Technology" copyrighted 2000.

* cited by examiner

*Primary Examiner*—J. Casimer Jacyna
(74) *Attorney, Agent, or Firm*—William L. Huebsch

(57) ABSTRACT

A combination for use in storing and applying moisture curable materials which includes (1) a container assembly with a tubular wall of moisture vapor transmissive polymeric material having an inner surface defining a chamber and a plunger within the tubular wall adapted to move along the wall toward an outlet end in sealing engagement with an inner surface of the wall; (2) a moisture curable material within the chamber which is solid at normal room temperature, is softenable to a suitable viscosity for application of less than 30,000 centipoise when heated to a temperature in the range of about 140 to 230 degrees Fahrenheit or 60 to 110 degrees Centigrade, and has little adhesion to the wall, even when said adhesive is moisture cured; and (3) an envelope of moisture impermeable material around the container assembly.

17 Claims, 2 Drawing Sheets

COMBINATION FOR STORING AND APPLYING HEAT SOFTENABLE MOISTURE CURABLE MATERIALS

FIELD OF THE INVENTION

The present invention relates to combinations, structures, devices, and methods for use in storing and applying heat softenable moisture curable materials such as adhesives, coatings or sealers.

BACKGROUND

Moisture curable adhesive materials (e.g., moisture curable urethane adhesives) are well known that are solid at room temperature, that can be heated to a flowable state for application, that after being applied between objects in their heated flowable state will adhere those objects together upon cooling, and that subsequent to solidifying will cure and build adhesive strength (i.e., adhesion to those objects and internal strength) by the absorption of atmospheric moisture. Such adhesive materials after being moisture cured can develop shear adhesion strength generally in the range of about 1000 pounds per square inch or about 690 newtons per square centimeter which is significantly greater than the range of shear adhesion strength of about 250 to 700 pounds per square inch or about 172 to 483 newtons per square centimeter that can be developed by conventional hot melt adhesives (i.e., hot melt adhesives are solid at room temperature, can be heated to a flowable state for application, after being applied between objects in their heated flowable state will adhere those objects together upon cooling, but have no means for developing significant further adhesive strength after cooling). While the adhesive strength of the moisture curable adhesive materials is not as high as that which can be developed using epoxy resins (i.e., epoxy resins can develop shear adhesion strengths in the range of about 2000 to 45000 pounds per square inch or 1379 to 3103 newtons per square centimeter), such moisture curable adhesive materials are more easily applied, require less clamping time before the material will solidify sufficiently to hold objects together, provide sufficient adhesive strength for use in many structural applications, and are less expensive than epoxy resins. Thus, there is significant commercial use of such moisture curable adhesive materials, particularly to join moisture vapor permeable materials (e.g., wood or plastic objects) together or to join one moisture vapor permeable material to another material that is not moisture vapor permeable (i.e., the moisture vapor permeable material or materials allow atmospheric moisture to enter and cure the adhesive material).

One problem with using moisture curable adhesive materials to join such objects is that they are typically applied using complex systems that are sealed against moisture, and the adhesive materials they apply must be heated to relatively high temperatures (e.g., 240 to 300 degrees Fahrenheit or 116 to 149 degrees Centigrade) before they will melt and can be applied. It takes a fairly long time (e.g., about 45 minutes) to initially bring the adhesive material in the system to the required application temperature, and maintaining the system at that temperature can normally only be justified if a fairly large amount of the adhesive material is to be applied over an extended period of time, such as to a series of objects moving along an assembly line. Thus, such moisture curable adhesive material application systems are impractical if only occasional applications of the adhesive material are required over an extended period of time.

DISCLOSURE OF THE INVENTION

The present invention provides a combination and method for storing and applying moisture curable materials (e.g., adhesives, coatings or sealers) that is inexpensive and practical for use even if only occasional applications of the moisture curable materials are required over an extended period of time.

This invention results from the recognition that moisture curable materials which, at about 140 to 230 degrees Fahrenheit or 60 to 110 degrees Centigrade, soften to a suitable flowable viscosity for application, can be stored in and applied from inexpensive container assemblies or syringes of polymeric materials that can withstand temperatures in that range and have sufficiently low surface energy that the moisture cured materials will not adhere well to them, even though, undesirably, those polymeric materials allow the passage of moisture vapor from the atmosphere. Even if moisture vapor transmission through the container assembly or syringe cures the material within it when the container assembly is exposed to the atmosphere, that cured material forms a bladder around uncured moisture curable material within the container assembly; and when the container assembly and material are heated into that range of about 140 to 230 degrees Fahrenheit or 60 to 110 degrees Centigrade that bladder will soften with the uncured material, will easily separate from the wall of the container assembly and collapse when pressure is applied to it because of the low surface energy of that wall, and will rupture under that pressure (or can be ruptured with an implement) so that the uncured material can be discharged from the container assembly.

The combination according to the present invention for use in storing and applying moisture curable materials comprises the container assembly or syringe including a tubular wall of moisture vapor transmissive polymeric material (e.g., material with a moisture vapor transmission (MVT) coefficient (cc-mil/100 square inch—24 hour—atm) of over 0.254 and up to at least 36), and a plunger or seal within the polymeric wall adjacent an inlet end of the wall that is adapted to move along the wall toward an outlet end of the wall in sealing engagement with an inner surface of the wall (e.g., a polypropylene or polyethylene syringe); and the moisture curable material within the chamber, which material is a solid at normal room temperature, will, when heated to a temperature in the range of about 140 to 230 degrees Fahrenheit or 60 to 110 degrees Centigrade, soften to a suitable flowable viscosity for application (e.g., a viscosity of less than 30,000 centipoise, preferably of less than 15,000 centipoise, and most preferably in the range of about 8,000 to 12,000 centipoise), and has little or no adhesion to the polymeric material in the tubular wall even when the material is moisture cured (e.g., the polymeric material in the tubular wall has a critical surface tension lower than about 35 dynes/centimeter). A removable layer or envelope of moisture impermeable material is provided entirely around the container assembly prior to its use. After (or possibly before) the container assembly is removed from the layer or envelope of moisture impermeable material it can be heated by various means to heat the moisture curable material within it to a suitable viscosity for application, after which various means can be used to drive the plunger along the wall toward its outlet end to discharge and apply the moisture curable material.

After the container assembly or syringe is removed from the layer or envelope of moisture impermeable material the moisture curable material within it will typically be useful for 3 to 4 days or more (i.e., that time may be extended if the moisture curable material is being used in a low humidity environment or if the container assembly or syringe is again sealed within the layer or envelope of moisture impermeable material between its uses to apply the moisture curable material). During the time that the container assembly or syringe is outside of the envelope and exposed to the atmosphere, atmospheric moisture vapor can pass through the walls of the container assembly or syringe, causing the moisture curable material to cure inwardly from its outer surface to form the bladder of the cured moisture curable material that will soften but will not melt upon heating. That bladder extends around a central core of uncured moisture curable material within the syringe that will still soften to a suitable viscosity for application when heated to a temperature in the range of about 140 to 230 degrees Fahrenheit or 60 to 110 degrees Centigrade. If the moisture curable material within the container assembly or syringe is thus heated and used within a short time after it is removed from the envelope of moisture impermeable material (e.g., within 1 to 10 hours) the thickness of that bladder will be negligible or so small that the bladder will easily rupture, flex, and easily separate from the wall of the container so that it will have no significant effect upon discharging the heated uncured moisture curable material from the container assembly or syringe. After a longer period of time (e.g., 12 to 96 hours) the bladder of moisture cured material can typically have become sufficiently thick (e.g., up to 0.06 inch or 0.625 mm thick) that it will have a significant effect upon discharging the heated uncured moisture curable material from the container assembly or syringe. That bladder, however, still may be ruptured by various means at the outlet end of the container assembly or syringe, and will be sufficiently flexible when heated and will be easily separable from the inner surface of the syringe (i.e., the moisture curable material even when cured has little or no adhesion to the polyolefin material forming the tubular wall) to afford movement of the plunger to flex or collapse the bladder and discharge the heat softened uncured moisture curable material from the syringe through that rupture in the bladder. With longer exposure to atmospheric moisture (e.g., over 4 days) the bladder of moisture cured material can have thickened sufficiently that it will be very difficult to rupture, however, the bladder becomes self sealing against further moisture penetration when it reaches a thickness of about ⅛ inch (0.32 cm), thereby for a long time protecting a central core of the uncured moisture curable material that still can be heated and removed with significant difficulty such as the use of an awl or punch to rupture the bladder through the outlet end of the container assembly or syringe, after which the bladder when heated will still be soft, collapsible and separable from the tubular wall so that the uncured moisture curable material in the container assembly or syringe can be expelled.

The moisture curable material within the chamber can be a moisture curable urethane adhesive such as those having the designation TE-100, TE-200 or TS-230 "Jet Weld" (T.M.) thermoset adhesive that are commercially available from Minnesota Mining and Manufacturing Company, St. Paul, Minn.

The tubular wall of moisture vapor transmissive polymeric material can be of a polyolefin material such as polyethylene or polypropylene which are readily available, relatively inexpensive, and have low surface energy or critical surface tension (i.e., it appears that the critical surface tension should be lower than about 35 dynes/centimeter which is the critical surface tension of ABS to which the moisture curable materials listed above will adhere quite strongly when moisture cured, but can be about 31 dynes/centimeter which is the critical surface tension of polyethylene, or about 29 dynes/centimeter which is the critical surface tension of polypropylene, to either of which those moisture curable materials have little adhesion when moisture cured). Polyethylene or polypropylene have relatively low Heat Deflection Temperatures under pressure which are reported in the Materials Selection chapter of Machine Design magazine's "Basics of Design Engineering", June, 1994, the content whereof is hereby incorporated herein by reference. (e.g., under 64 pounds per square inch or 4.5 kilograms per square centimeter pressure the Heat Deflection Temperature (HDT) for medium density polyethylene is about 120 to 165 degrees Fahrenheit or 49 to 74 degrees Centigrade, the Heat Deflection Temperature for high density polyethylene is about 140 to 190 degrees Fahrenheit or 60 to 88 degrees Centigrade, and the Heat Deflection Temperature for unmodified polypropylene is about 200 to 250 degrees Fahrenheit or 93 to 121 degrees Centigrade). Such materials, however, can be suitable for use with the type of moisture curable material described above which softens to a suitable viscosity for application when heated to a temperature in the range of about 140 to 230 degrees Fahrenheit or 60 to 110 degrees Centigrade, and preferably in the range of about 180 to 190 degrees Fahrenheit or 82 to 88 degrees Centigrade. Syringes molded of these materials having various capacities (e.g., 32 cubic centimeters) and which have at the outlet ends of their walls a transverse end wall from the center of which projects a outlet nozzle are readily commercially available (e.g., from Plas-Pak Industries, Inc., Norwich, Conn.). Such a syringe filled with the moisture curable material that is sealed within the removable envelope of moisture impermeable material can be stored for a long period of time (e.g., over 6 months at 90 degrees Fahrenheit or 32 degrees Centigrade and 90 percent relative humidity).

The means for receiving the container assembly after it is removed from the envelope of moisture impermeable material and for heating the moisture curable material in it to a suitable viscosity for application can be an electrically heated cylindrical chamber adapted to closely receive the tubular wall of the container assembly. The container assembly can either be inserted into that chamber for a time sufficient to soften the moisture curable material and then removed from the chamber while the heated moisture curable material is applied, which facilitates manipulation of the container assembly or syringe during application of the moisture curable material; or the container assembly can remain in the heated chamber during application of the moisture curable material from an end portion of container assembly projecting from the chamber which insures that the moisture curable material will remain at the temperature needed for application over an extended period of time. If the container assembly remains in the heated chamber during application of the moisture curable material, that chamber can either be mounted at a fixed location, or can be moved with the container to a location at which the moisture curable material is to be applied. As an alternative to use of such a heated chamber, the container assembly can be heated by other means, such as by immersing the container assembly in boiling water, by the use of an oven, or otherwise.

The means adapted for engagement with the container assembly which can be activated to drive the plunger or seal along the tubular wall of the container toward its outlet end to discharge and apply the heated moisture curable material can be in the form of a projection of about the same length as the tubular wall that has an end in engagement with the plunger and projects from the inlet end of the tubular wall where it may be manually engaged at its opposite end to manually move the plunger and discharge the heated moisture curable material from the outlet end of the tubular wall. Alternatively, that means can be in the form of a commercially available applicator that has a frame adapted to engage the inlet end of the tubular wall, has a driver adapted for contact with the plunger, and has a ratchet mechanism between the frame and the driver assembly that is manually activateable to move the driver and thereby the plunger to discharge heated moisture curable material from the outlet end of the tubular wall. A suitable pneumatically or electrically operated applicator could also be used. Also, that applicator can either be portable or adapted to be mounted on a bench or the like.

BRIEF DESCRIPTION OF THE DRAWING

The present invention will be further described with reference to the accompanying drawing wherein, like parts are identified with like reference numerals in the several views, and wherein.

DETAILED DESCRIPTION OF THE INVENTION

Figure 1:
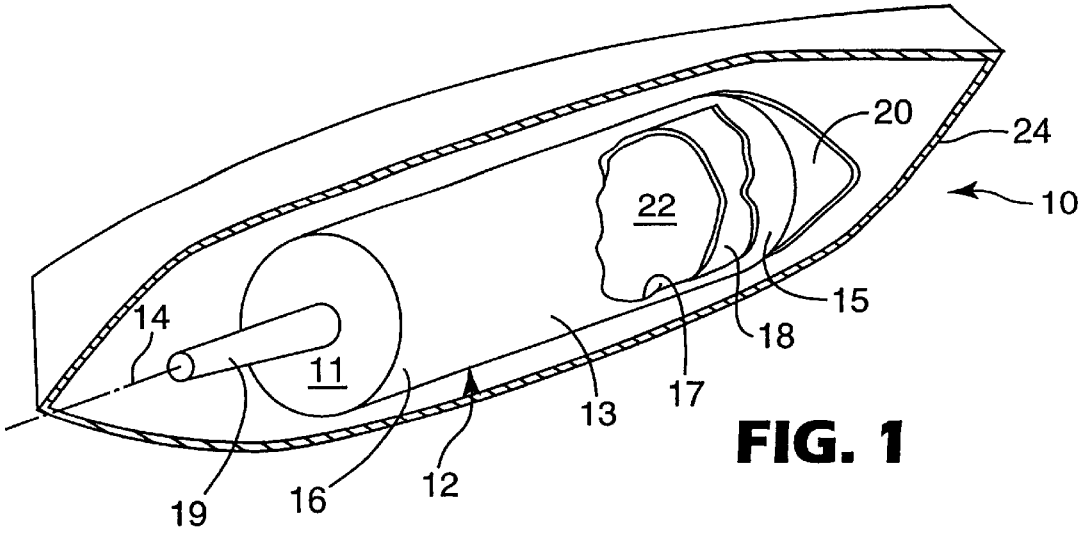
FIG. 1 is a perspective view of a combination according to the present invention for use in storing and applying a heat softenable moisture curing material, which combination has parts broken away and sectioned to show details.
Figure 2:
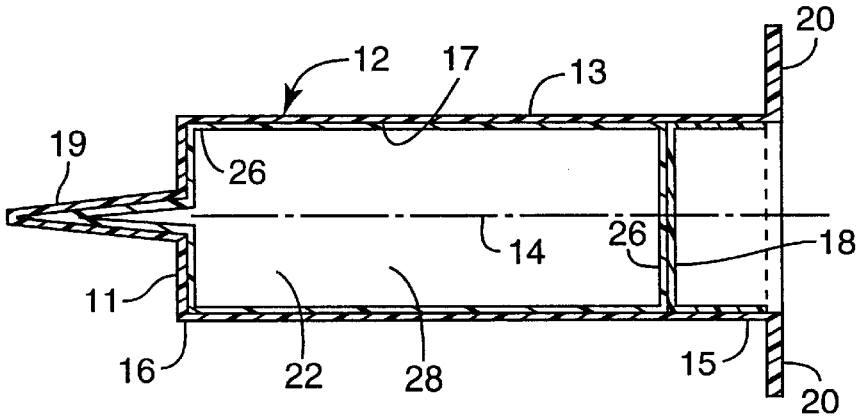
FIG. 2 is a longitudinally sectioned view of a container assembly included in the combination of FIG. 1, which container assembly has been removed from an envelope of moisture impermeable material included in that combination and illustrates a bladder of moisture cured material within the container assembly that will develop because of atmospheric moisture passing through the walls of the container assembly.
Figure 3:
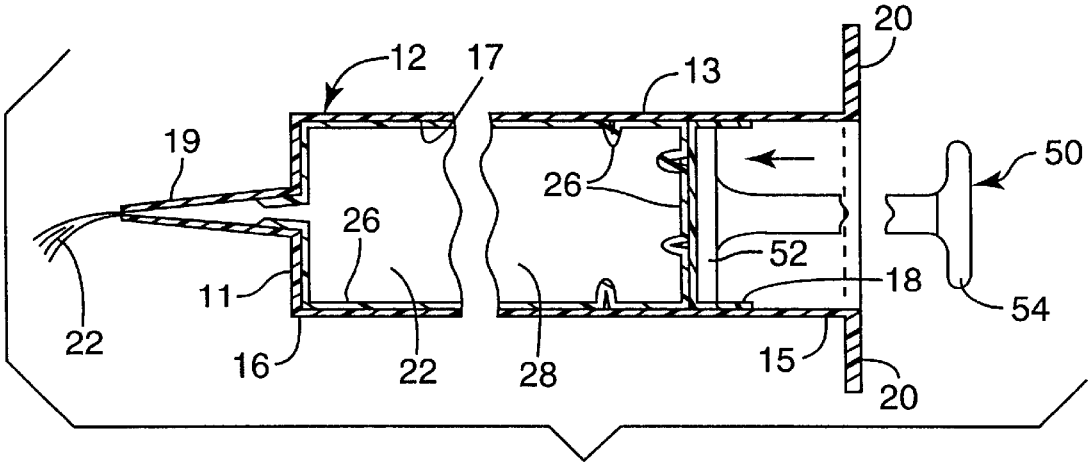
FIG. 3 is a fragmentary longitudinally sectioned view of the container assembly of FIG. 2 that is being activated to discharge material from the container assembly and shows deformation of the bladder of moisture cured material within the container assembly as the material is discharged.

Referring now to FIGS. 1, 2, and 3 of the drawing there is illustrated a combination according to the present invention for use in storing and applying a heat softenable moisture curing material (e.g., an adhesive, coating or sealer), which combination is generally designated by the reference numeral 10.

Generally, the combination 10 comprises a container assembly or syringe 12 comprising a molded tubular wall 13 of moisture vapor transmissive polymeric material having low surface energy. (e.g., fluropolymers such as Teflon; or olefins such as polypropylene or polyethylene which have critical surface tensions below about 35 dynes/centimeters and are preferred because of their low cost). The tubular wall 13 has an elongate axis 14, axially spaced inlet and outlet ends 15 and 16, and an inner surface defining a chamber 17. The container assembly 12 also includes a plunger or seal 18 within the tubular wall 13 adjacent its inlet end and 15 that is adapted to move along that tubular wall 13 toward its outlet end 16 in sealing engagement with its inner surface. As an example, the container assembly 12 can be the 32 cc syringe molded of polypropylene that is reported to have a moisture vapor transmission (MVT) coefficient (cc-mil/100 square inch—24 hour—atm) of about 0.7 and is commercially available from Plas-Pak Industries, Inc., Norwich, Conn., under the trade designation "Montell S. R. 549M". The container assembly or syringe 12 as illustrated has at the outlet end 16 of its tubular wall 13 a transverse end wall 11 from the center of which projects a generally cylindrical outlet nozzle 19; and has at the inlet end 15 of its tubular wall 13 opposite radially outwardly projecting tapered projections 20 by which the wall 13 may be engaged either manually or by a mechanism with which the syringe is manipulated. The combination 10 also includes a quantity of uncured moisture curable material 22 within the chamber 17, which uncured material 22 is a solid at normal room temperature, will, when heated to a temperature in the range of about 140 to 230 degrees Fahrenheit or 60 to 110 degrees Centigrade, soften to a suitable viscosity for application (e.g., a viscosity of less than 30,000 centipoise, preferably of less than 15,000 centipoise, and most preferably in the range of about 8,000 to 12,000 centipoise), and has little or no adhesion to the polymeric material from which the container assembly 12 is made, even when the material 22 is moisture cured (i.e., the polymeric material has a critical surface tension lower than about 35 dynes/centimeter, for example about 31 dynes/centimeter which is the critical surface tension of polyethylene or about 29 dynes centimeter which is the critical surface tension of polypropylene). The combination 10 also includes a layer or envelope 24 of moisture impermeable material around the container assembly 12, which envelope 24 can, for example, be a laminate including a layer of metal foil, such as the laminate of polymeric film and metal foil commercially designated "Marvelseal 360", or the laminate of paper and metal foil commercially designated "Marvelseal 1312", both of which are available from Ludlow, Homer, La.

The moisture vapor transmission (MVT) coefficient (cc-mil/100 square inch—24 hour—atm) of the moisture vapor transmissive polymeric material (e.g., polypropylene or polyethylene) in the container assembly 12 can be over 0.254 and up to at least 35.56; that moisture vapor transmission coefficient currently being reported by the "Online Materials Information Resource", http://www.matweb.com/GetMatlsEnglish.asp on the internet (the content whereof is hereby incorporated herein by reference) as about 23.876 for molded polypropylene, and much less for polyethylenes, either of which materials (or combinations thereof) could be used in the container assembly 12.

The container assembly 12 can be removed from the envelope 24, the material 22 within the container assembly or syringe 12 can be softened to a suitable viscosity for application by heating it to a temperature in the range of about 140 to 230 degrees Fahrenheit or 60 to 110 degrees Centigrade, and the plunger 18 can be driven along the wall 13 toward its outlet end 16 by various known means to discharge the heated material 22 from the container assembly 12 through the nozzle 19 so that it can be applied to a substrate.

During the time that the container assembly or syringe 12 is outside of the envelope and exposed to the atmosphere, moisture vapor can pass through the walls 13, 11, 19, and plunger 18 of the container assembly 12, causing the material 22 to cure inwardly from its outer surface to form, as is illustrated in FIG. 2, a cured layer 26 of the material 22 that extends as a bladder around a central core of uncured material 28 within the container assembly 12. That cured layer 26 of material 22 will become much more flexible but will not melt upon heating, however, the central core 28 of uncured material 22 within the container assembly 12 will soften to a suitable viscosity for application when it is heated. If the material 22 within the container assembly 12 is thus heated and used within a short time after it is removed from the envelope 24 of moisture impermeable material (e.g., within 1 to 10 hours) the thickness of the cured layer 26 of material 22 will usually be negligible or so small that it will easily rupture and flex and will easily separate from the wall 13 so that it will have no significant effect upon discharging the heated uncured material 22 from the container assembly 12 through the nozzle 19. After a longer period of time (e.g., 12 to 96 hours) the moisture cured layer 26 of adhesive 22 can have become sufficiently thick (e.g., 1/32 to 1/8 inch or 0.008 to 0.32 cm thick) that it can have a significant effect upon discharging the core 28 of heated uncured material 22 from the container assembly or syringe 12. That layer of moisture cured adhesive 26, however, may still be ruptured by various means in the nozzle 19 and at the end wall 11 of the container assembly 12, and when heated will be sufficiently flexible and separable from the inner surface of the container assembly 12 formed by the wall 13 and plunger 18 (i.e., the adhesive 22 even when cured has little or no adhesion to the polyolefin material forming the tubular wall 13 and plunger 18) to afford movement of the plunger 18 to flex or collapse the layer of moisture cured adhesive 26 and discharge the heat softened uncured material 22 from the container assembly 12 through that rupture in the layer of cured adhesive 26 and the nozzle 19 as is illustrated in FIG. 3.

As a non limiting example, the uncured moisture curable material 22 within the chamber be an adhesive such as one of the moisture curable urethane adhesives having the designation TE-100, TE-200 or TS-230 "Jet Weld" (TM) thermoset adhesive that are commercially available from Minnesota Mining and Manufacturing Company, St. Paul, Minn.

Figure 4:
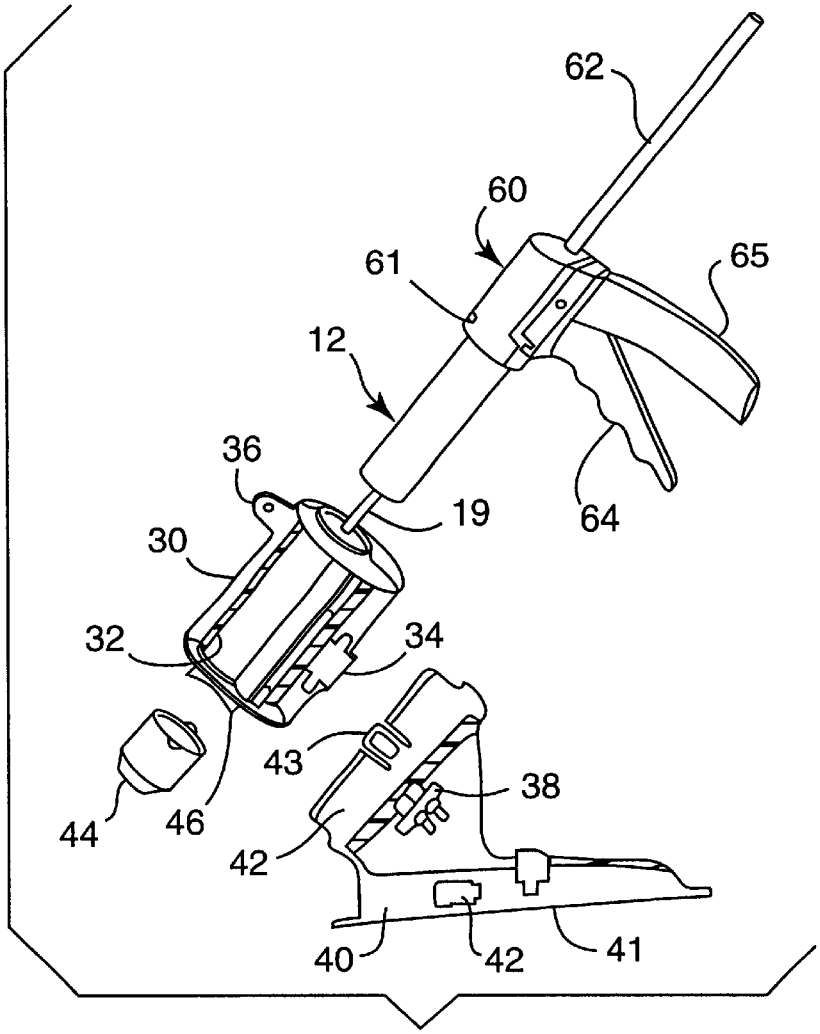
FIG. 4 is an exploded side view of the container assembly included in the combination of FIG. 1, which container assembly has been removed from the envelope of moisture impermeable material included in that combination and is shown with a partially sectioned heater assembly that can be used to heat the container assembly together with a drive mechanism that can be manually activated to drive a plunger through the container assembly to discharge material softened by the heater assembly.

As is illustrated in FIG. 4, the means for heating the uncured material 22 in the container assembly 12 to a temperature in the range of about 140 to 230 degrees Fahrenheit to soften it to a suitable viscosity for application after the container assembly 12 is removed from the envelope 24 can be a heating assembly 30 having an inner surface defining a through cylindrical chamber 32 adapted to closely receive the tubular wall 13 of the container assembly or syringe 12. A temperature regulated electrical heater (e.g., regulated by a thermostat, positive temperature coefficient (PTC) regulation, or the like) surrounds the chamber 32 and will heat the container assembly 12 when it is in the chamber 32. The container assembly or syringe 12 can be inserted into the chamber 32 for a time sufficient to soften the material 22 and then removed from the chamber while the heated material 22 is applied, which facilitates the mobility and manipulation of the container assembly 12 during application of the material 22. Alternatively, the container assembly 12 can remain in the chamber 32 of the heating assembly 30 during application of the material 22 from the nozzle 19 which projects from the chamber 32 to insure that the material 22 will remain at the temperature needed for application over an extended period of time. Electricity is connected to the heating assembly 30 through a plug 34. The plug 34 can be directly connected to a source of electricity by a flexible electrical cord (not shown) so that the heating assembly 30 can be easily moved about, and the heating assembly 30 has a projection 36 by which it can be supported from an overhead structure (not shown). Alternatively, the plug 34 can be engaged with a mating plug 38 in a base 40 that has a bottom surface 41 adapted to be supported on a horizontal surface, defines a cradle 42 adapted to receive and releasably engage the bottom portion of the heating assembly when the plugs 34 and 38 and latching members 43 on the heating assembly 30 and the base 40 are engaged, and can be connected to a source of electricity through a switch 42 by which the source of electricity to the heating assembly 30 can be turned on and off. A molded cup 44 of silicone rubber can be releasably engaged over a lip 46 around the end of the chamber 32 from which the nozzle 19 projects when the syringe or container assembly 12 is in the chamber 32 of the heating assembly 30. That cup 44 catches drippings of the material 22 from the nozzle 19 as the syringe or container assembly 12 is heated, and is easily removable from the lip 46 for cleaning.

The means adapted for engagement with the container assembly or syringe 12 which can be activated to drive the plunger 18 along the wall 13 toward its outlet end 16 to discharge and apply the adhesive 22 can, as is illustrated in FIG. 3, be in the form of a projection 50 of about the same length as the wall 13 that has an end 52 in engagement with the plunger 18 and projects from the inlet end 15 of the wall 13 where it may be manually engaged at its opposite end 54 to manually move the plunger 18 and discharge material 22 through the nozzle 19 at the outlet end 16 of the wall 13. As is conventional, a person engages the projections 20 with two adjacent fingers and applies pressure to the end 54 of the projection 50 with the palm of his or her hand to move the plunger 18 and discharge the material 22.

Figure 5:
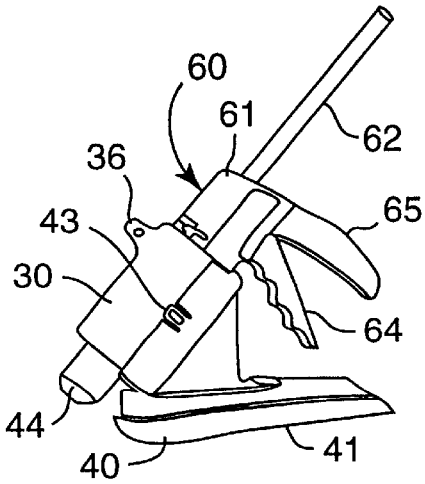
FIG. 5 is a perspective view of the container assembly, heater assembly, and drive mechanism of FIG. 4 shown in the relative positions in which they are placed when the container assembly is being heated by the heater assembly.
Figure 6:
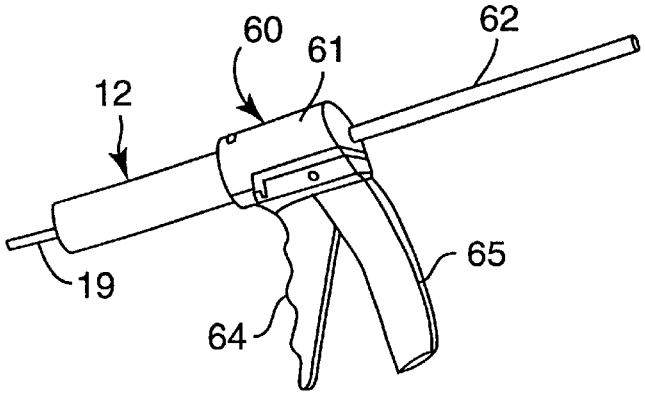
FIG. 6 is a side view of the container assembly and drive mechanism of FIG. 5 shown in the relative positions in which they are placed when heated material is being discharged from the container assembly by the drive mechanism.

Alternatively, as is illustrated in FIGS. 4, 5, and 6, that means adapted for engagement with the container assembly or syringe 12 which can be activated to drive the plunger 18 along the wall 13 toward its outlet end 16 to discharge and apply the adhesive 22 can be in the form of a commercially available applicator 60 (i.e., the "manual gun" or applicator commercially available from Plas-Pak Industries, Inc., Norwich, Conn.) that has a frame 61 adapted to engage the projections 20 at the inlet end 15 of the wall 13, has a driver 62 adapted for contact with the plunger 18, and has a ratchet mechanism between the frame 61 and the driver 62 that is manually activateable by moving a lever 64 pivoted on the frame 61 toward a handle 65 fixed to the frame 61 to move the driver 62 and thereby the plunger 18 to discharge adhesive from the nozzle 19 at the outlet end 16 of the wall 13. As is illustrated in FIGS. 4, 5, and 6, the applicator 60 can be engaged with the container assembly or syringe 12 prior to inserting the container assembly or syringe 12 in the chamber 32 of the heating assembly 30 (see FIG. 5). After the material 22 in the container assembly or syringe 12 has been heated to a suitable viscosity for application by the heating assembly 30, the applicator 60 with the container assembly or syringe 12 attached can be removed from the heating assembly as illustrated in FIG. 6 and then used to apply material 22 from the container assembly or syringe 12 to a substrate.

The present invention has now been described with reference to one combination, several devices facilitating the use thereof, and a method for using that combination. It will be apparent to those skilled in the art that many changes can be made in the combination described and the devices and method described for using that combination without departing from the scope of the present invention. Thus the scope of the present invention should not be limited to the combination, devices and methods described in this application, but only by the combination, devices and methods described by the language of the claims and the equivalents thereof.

What is claimed is:

1. A combination for use in storing and applying moisture curable materials, said combination comprising:

a container assembly comprising:

a tubular wall of moisture vapor transmissive polymeric material, said tubular wall having an elongate axis, axially spaced inlet and outlet ends, and an inner surface defining a chamber; and a plunger within said tubular wall adjacent said inlet end and adapted to move along said wall toward said outlet end in sealing engagement with said inner surface;

a moisture curable material within said chamber, said material having an outer surface, being a solid at normal room temperature, being softenable to a suitable viscosity for application of less than 30,000 centipoise when heated to a temperature in the range of about 140 to 230 degrees Fahrenheit or 60 to 110 degrees Centigrade, and having little adhesion to said polymeric material, even when said adhesive is moisture cured, said moisture curable material being curable inwardly from said outer surface by atmospheric moisture vapor to form a bladder of the cured moisture curable material that will soften but will not melt upon heating in said range, said bladder then extending around a central core of uncured moisture curable material; and an envelope of moisture impermeable material around said container assembly, whereby after the envelope of moisture impermeable material is removed said moisture curable material can be cured inwardly from said outer surface by atmospheric moisture vapor passing through the walls of the container assembly to form the bladder of cured moisture curable material, and after any such bladder and the uncured moisture curable material within the container assembly are heated to a temperature in said range, the bladder can be ruptured so that the plunger can be moved along the wall toward the outlet end of the wall to collapse the ruptured bladder and separate parts of the bladder adjacent the plunger from the container assembly while the heated uncured moisture curable material is discharged through the outlet end of the tubular wall.

2. A combination according to claim 1 wherein said moisture curable material has a viscosity of less than 15,000 centipoise when heated to a temperature in the range of about 140 to 230 degrees Fahrenheit or 60 to 110 degrees Centigrade.

3. A combination according to claim 1 wherein said moisture curable material has a viscosity in the range of about 8,000 to 12,000 centipoise when heated to a temperature in the range of about 140 to 230 degrees Fahrenheit or 60 to 110 degrees Centigrade.

4. A combination according to claim 1 wherein said moisture vapor transmissive polymeric material in said wall is a polyolefin.

5. A combination according to claim 1 wherein said polymeric material in said wall has a critical surface tension of less than about 35 dynes/centimeter.

6. A combination according to claim 1 wherein said polymeric material in said wall has a moisture vapor transmission (MVT) coefficient of over 0.254 cc-mil/100 square inch—24 hour—atm.

7. A combination according to claim 1 further including means adapted for receiving said container assembly and heating said moisture curable material above said temperature at which said moisture curable material is softened.

8. A combination according to claim 7 wherein said means adapted for receiving said container assembly and heating said moisture curable material above said temperature at which said moisture curable material is softened comprises an electrically actuated heater having a through opening adapted to receive said tubular wall.

9. A combination according to claim 1 further including means adapted to engage said container assembly for driving said plunger along said tubular wall toward said outlet end.

10. A combination according to claim 9 wherein said means adapted to engage said container assembly for driving said plunger along said tubular wall toward said outlet end comprises a drive mechanism operated by a mechanical ratchet mechanism, electricity or compressed air.

11. A method for storing and applying moisture curable materials, said method comprising the steps of:

providing a container assembly including a tubular wall of moisture vapor transmissive polymeric material, said tubular wall having an elongate axis, axially spaced inlet and outlet ends, and an inner surface defining a chamber; and a plunger within said tubular wall adjacent said inlet end and adapted to move along said wall toward said outlet end in sealing engagement with said inner surface;

providing a moisture curable material within said chamber, said material being a solid at normal room temperature, being softenable to a suitable viscosity for application of less than 30,000 centipoise when heated to a temperature in the range of about 140 to 230 degrees Fahrenheit or 60 to 110 degrees Centigrade, and having little adhesion to said polymeric material, even when said adhesive is moisture cured;

providing an envelope of moisture impermeable material around the container assembly;

removing the container assembly from the envelope of moisture impermeable material, thereby allowing atmospheric moisture vapor to pass through the walls of the container assembly, causing the moisture curable material to cure inwardly from its outer surface to form a bladder of the cured moisture curable material that will soften but will not melt upon heating, which bladder extends around a central core of uncured moisture curable material within the chamber;

heating the bladder and the uncured moisture curable material within the container assembly to a temperature in the range of about 140 to 230 degrees Fahrenheit or 60 to 110 degrees Centigrade;

rupturing the bladder within the container assembly; and moving the plunger along the wall toward the outlet end of the wall to collapse the ruptured bladder and separate parts of the bladder adjacent the plunger from the container assembly so that the heated uncured moisture curable material will be discharged from the container assembly.

12. A method according to claim 11 wherein said step of rupturing the bladder is accomplished by pressure developed in the bladder during said step of moving the plunger along the wall toward the outlet end of the wall.

13. A method according to claim 11 wherein said step of rupturing the bladder comprises puncturing the bladder with an implement through the outlet end of the wall.

14. A method according to claim 11 wherein said step of moving the plunger along the wall toward the outlet end of the wall comprises the step of manually applying force to move the plunger.

15. A method according to claim 11 wherein said step of moving the plunger along the wall toward the outlet end of the wall comprises the step of applying force with a drive mechanism operated by a mechanical ratchet mechanism, electricity or compressed air.

16. A method according to claim 11 wherein said step of heating the bladder and the uncured moisture curable material within the container assembly comprises the step of positioning the wall of the container assembly within an electrically actuated heater.

17. A method according to claim 11 wherein said step of heating the bladder and the uncured moisture curable material within the container assembly comprises the step of positioning the container assembly in boiling water.

* * * * *